United States Patent [19]

Burghoff et al.

[11] Patent Number: 4,680,952

[45] Date of Patent: Jul. 21, 1987

[54] PROCESS AND APPARATUS FOR THE PRODUCTION OF STRANDS FOR BOWDEN CABLES

[75] Inventors: Karl Burghoff, Oberursel; Werner Schiller, Erzhausen; Wilhelm Albrecht, Vaihingen; Herbert Harsch, Waiblingen-Bickenfeld; Heinz-Georg Burghoff, Reichenbach, all of Fed. Rep. of Germany

[73] Assignee: Max Kammerer GmbH, Fed. Rep. of Germany

[21] Appl. No.: 702,634

[22] Filed: Feb. 19, 1985

[30] Foreign Application Priority Data

Feb. 17, 1984 [DE] Fed. Rep. of Germany ..... 3405693

[51] Int. Cl.[4] ..... B21D 1/02; B21C 19/00

[52] U.S. Cl. ..... 72/161; 72/183

[58] Field of Search ..... 72/161, 162, 183

[56] References Cited

U.S. PATENT DOCUMENTS

| | | | |
|---|---|---|---|
| 3,348,400 | 10/1967 | Korf | 72/161 |
| 3,362,202 | 1/1968 | Gay | 72/161 |
| 3,429,164 | 2/1969 | Oganowski et al. | 72/161 |
| 3,839,888 | 10/1974 | Greenberger | 72/161 |
| 4,216,666 | 8/1980 | Wu | 72/161 |

FOREIGN PATENT DOCUMENTS

| | | | |
|---|---|---|---|
| 715171 | 2/1980 | U.S.S.R. | 72/161 |

*Primary Examiner*—W. D. Bray
*Attorney, Agent, or Firm*—Robert J. Koch

[57] ABSTRACT

A process for the production and further processing of strands for Bowden cables of several wires stranded together by twisting, comprising dressing the strands after stranding between reversing rolls, subsequently stretching and again dressing between reversing rolls. Dressing is effected prior to stretching in several stages with decreasing bending radii and after the stretching again in several stages with increasing bending radii, while the stretching is performed with a force approximately within the area of the elastic limit, corresponding to 45% to 70%, preferably to 55% and 65% of the ultimate tensile strength of the strand. The apparatus comprises a dressing line of two roll conveyors with reversing rolls set in gaps with respect to each other on alternating sides, a stretching line with two tension sheaves set at a constant distance, one of which is driven by a brake motor and the other by a tension motor, another dressing line of two roll conveyors with reversing rolls set in gaps with respect to each other on alternating sides. The rolls of the lower conveyor and of the upper conveyor are combined respectively in magazines and the lower conveyor is mounted stationarily and the upper conveyor is mounted on a stand in a height adjustable manner perpendicularly to the lower conveyor.

11 Claims, 4 Drawing Figures

FIG. 3
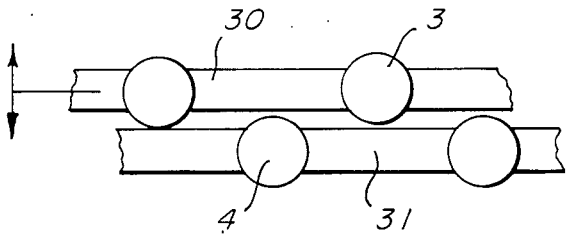
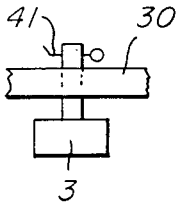
FIG. 4

PROCESS AND APPARATUS FOR THE PRODUCTION OF STRANDS FOR BOWDEN CABLES

BACKGROUND OF THE INVENTION

1. Field Of The Invention

The invention relates to a process and an apparatus for the production and further processing of strands for Bowden cables from a plurality of wires stranded together by twisting.

2. Background Of The Art

It is known to use Bowden cables for the transmission of tensile and compressive forces. Bowden cables comprise a flexible pull wire formed by strands prepared by twisting, a flexible tube surrounding the pull wire and sheathing formed of wire fabric, wire mesh or tightly wound wire spirals. The known Bowden cables are found to be highly satisfactory in applications involving the transmission of high tensile forces or in some case even compressive forces. However, they could not be used heretofore in applications requiring great accuracy and consistency of control. The essential cause of this condition is the fact that the strands, elongate elastically in themselves, i.e. without an elastic or even plastic deformation of the individual wires of the strands, under the effect of the control forces to be transmitted, and subsequently contract upon their release. On the one hand, the measure of the elastic elongation and contraction is undetermined and varies from cycle to cycle, and on the other hand, changes in length remaining in superposition may occur. In a measuring apparatus or control segment this phenomena leads to a permanent change in the zero point of the measuring apparatus or the control element. This is true of strands from both single wires and composite strands.

SUMMARY OF THE INVENTION

An object of the present invention is to provide a process and an apparatus for the production of strands, which under normal operating loads, exhibit no temporary or permanent changes in length. Such strands are therefore suitable for use in Bowden cables for the transmission of control forces in measuring and control segments and the like, in which high control and positional accuracies and control constancies are required.

The process according to the invention comprises dressing the strand by means of multiple, alternating flexing over reversing rolls, then stretching and again dressing by flexing over reversing rolls.

The invention provides a process whereby twisted strands may be finish dressed to the extent that they no longer undergo elastic and permanent changes in length under operating loads, thereby assuring a high degree of uniformity in length. These strands may then be used in Bowden cables intended for applications in control and measuring segments. For example, the transmission of the control force of a clutch or gas actuation of an automatic drive in automotive vehicles, becomes possible. In the process, by means of the flexing over reversing rolls, a "compression" of the strands is eliminated, i.e., the unavoidable manufacturing play in the strands is eliminated. By the subsequent stretching of the strand already elongated to its maximum value, the elimination of the "elastic strain" occurs. In this fashion, the elasticity of the strand is reduced surprisingly as the result of the dressing before and after the stretching, with the elasticity becoming effective only under higher loads beyond the range of the regular control forces.

Advantageously, the dressing prior to stretching is effected by reversing in several stages with decreasing bending radii. The dressing following the stretching is again in several stages with increasing bending radii. On the one hand, as the result of flexing with decreasing bending radii prior to stretching, a good densification of the stranding is obtained. On the other hand, due to flexing with rising bending radii after stretching, the strand is elongated into its extended form. Appropriately, stretching is effected with a force slightly under the elastic limit, amounting to 45% to 70%, and preferably to between 55% and 65% of the ultimate tensile strength of the strand. A satisfactory development of the elastic strain is obtained, together with cold work hardening by the permanent deformation of the strand wires.

The apparatus according to the invention for the realization of the process of the invention comprises a dressing roll line of two roll conveyors with the reversing rolls arranged in mutually alternating gaps, a stretching line or two drawing sheaves arranged at a constant distance, one of which is driven by a brake motor and the other by a tension motor, another dressing line of two roll conveyors with reversing rolls arranged in mutually alternating gaps, and a coiling device for the winding of the stretched and dressed strand. In the device, conveniently the rolls of the lower and the upper roll conveyors are combined in a magazine, with the lower roll conveyor of the dressing line being mounted stationary and the upper roll conveyor mounted on a stand perpendicular to the lower roll conveyor in an adjustable height. The roll conveyors may be interchangeable, with the rolls of the roll conveyors being at a continuously varying distance and/or having a continuously varying diameter. It is possible thereby to thread the strand in a simple manner into the dressing apparatus and to adjust the latter to the bending radii adapted to the prevailing thickness of the strand merely by raising the upper roll magazine and after the passage of the strand, lowering it, until the reversing rolls, placed in gaps with respect to each other, are more or less in engagement. By replacing the magazines with magazines comprising rolls with larger or smaller diameters, the bending radius may be varied within a wide range adjusted to the prevailing strands.

BRIEF DESCRIPTION OF THE DRAWING

The invention shown in the drawing illustrates an embodiment of an apparatus for the production of strands for Bowden cables according to the invention. In the drawing:

FIG. 3 shows a portion of upper and lower roll magazine; and

FIG. 4 shows a pin mounted roll.

DETAILED DESCRIPTION OF THE PREFERRED EMBODIMENTS

Figure 1:
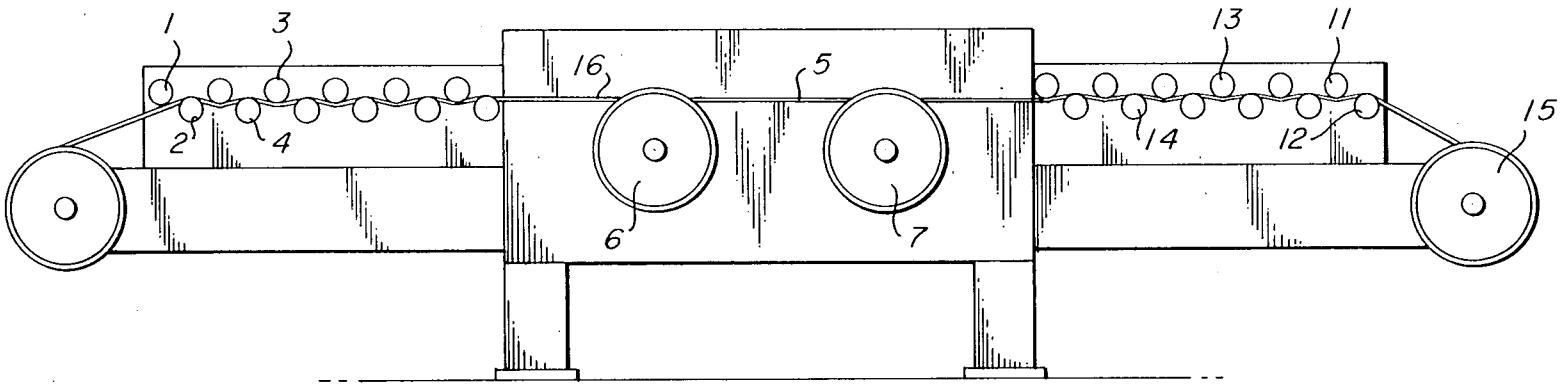
FIG. 1 shows a lateral elevation of a dressing and stretching line.
Figure 2:
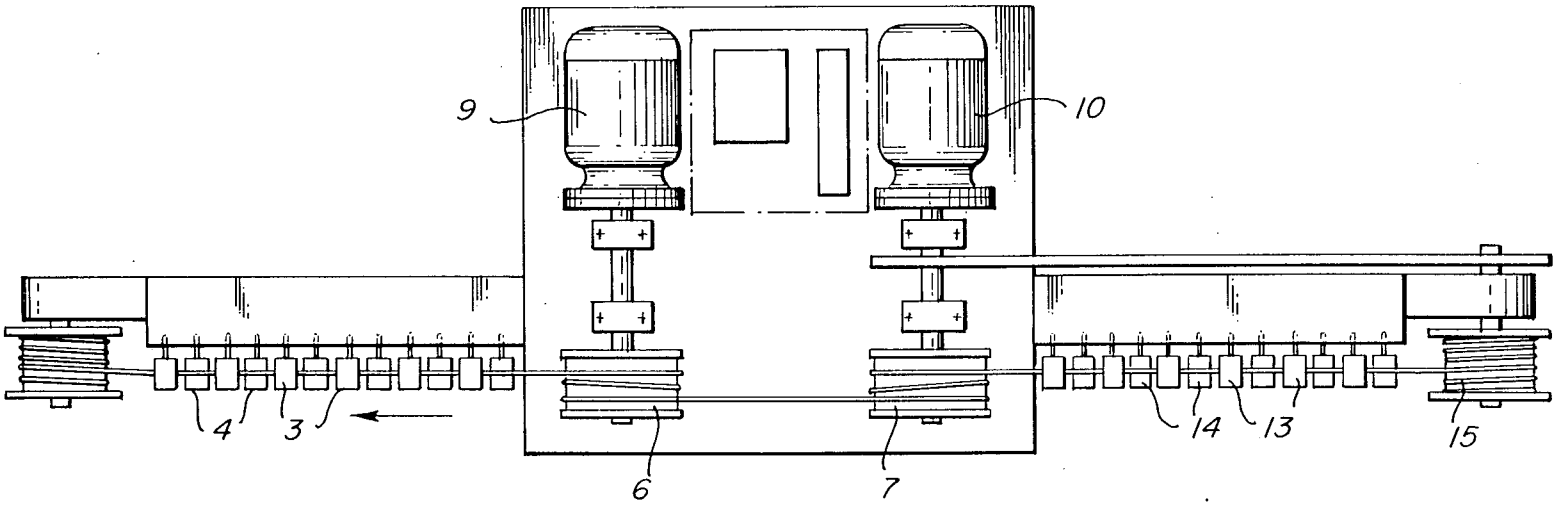
FIG. 2 illustrates a top view of the device of FIG. 1.

The apparatus shown in the drawing comprises a dressing line with two roll conveyors 1, 2, with the reversing rolls 3, 4 set in gaps with respect to each other on alternating sides, a stretching line 5 of two tension sheaves 6, 7 arranged at a constant, predetermined distance, one of which is driven by a brake motor 9 in FIG.

2 and the other by a tension motor 10, a second dressing line with two roll conveyors 11, 12, with the reversing rolls 13, 14 set in gaps with respect to each other on alternating sides, and a coiling device 15 for the winding of the stretched and dressed strand. The rolls of the lower roll conveyor 2, 12 and of the upper roll conveyor 1, 11 are combined respectively in a magazine, with the lower roll conveyors 2, 12 of the dressing line being mounted stationarily and the upper roll conveyors 1, 11 in a height adjustable manner perpendicularly to the plane of the lower roll conveyor, on a stand. The rolls 3, 4, 13, 14 of the roll conveyors are at a constant distance in the example, but in order to provide greater variability in the choice of the change of bending radii, they may be at continuously variable distances and/or have continuously variable diameters. The roll conveyors 1, 2, 11, 12 are interchangeable by a means for replacement such as a pin 41 for example as shown in FIG. 4.

By the passing of the strand 16 through the dressing line 1, 2 initially a compression of the strand according to the values determined by the selection of the bending radii is obtained, while on the stretching line, the elimination of the elastic strain inherent in a laid strand is effected. In the process, the stretching force to be applied may be limited exactly to the measure desired, which is slightly under the elastic limit and corresponds to 45% to 70%, preferably 55% to 56% of the ultimate tensile strength of the strand, based on the constant length of the stretching line by the predetermination of the tensile force applied by the motor 10 in relation to the braking force. In the subsequent dressing line 11, 12 the elongation of the strand into its strained form is effected. The foregoing specific embodiments are illustrative of one method and apparatus for carrying out the invention and are not to be considered as limiting the scope of the invention. Other embodiments will be apparent from the foregoing description and are also encompassed by the invention as defined in the following claims.

What is claimed is:

1. Process for treatment of strands for Bowden cables comprising:

dressing a plurality of twisted wire strands between a first set of reversing rollers;

stretching said dressed strands; and dressing said stretched strands between a second set or reversing rollers.

2. The process of claim 1 wherein, said dressing step between said first set of reversing rollers is effected in a plurality of stages with decreasing bending radii and said dressing step between said second set of reversing rollers is effected in a plurality of steps with increasing bending radii.

3. The process of claim 1 wherein, said stretching step is effected with a controlled force less than the elastic limit of said strands.

4. The process of claim 3 wherein, said force is from about 45% to about 70% of the tensile strength of said strands.

5. The process of claim 4 wherein, said force is from about 55% to about 65% of the tensile strength of said strands.

6. An apparatus for the treatment of strands for Bowden cables comprising:

a first dressing station having a plurality of reversing rollers for passage of said strands therethrough;

a stretching station having a pair of tension sheaves arranged at a distance from one another for stretching said strands therebetween;

a brake motor for driving one of said pair of tension sheaves;

a tension motor for driving the other of said pair of tension sheaves;

a second dressing station having a plurality of reversing rollers for passage of said strands therethrough; and a coiling device for winding the dressed and stretched strands, wherein said stretching station is located between said first dressing station and said second dressing station.

7. The apparatus of claim 6 wherein, said plurality of reversing rollers are mounted in gaps with respect to one another along a line of passage of said stands.

8. The apparatus of claim 7 wherein, the first and last pair of rollers of said plurality of reversing rollers along said line of passage are combined in a first and last magazine.

9. The apparatus of claim 8 wherein, said lower rollers of said first and said last magazines are mounted stationary along said line of passage and said upper rollers of said first and said last magazines are mounted adjustably perpendicular to said line of passage.

10. The apparatus of claim 6 wherein, said plurality of reversing rollers comprise rollers of varying diameters arranged at varying distances from one another.

11. The apparatus of claim 6 further comprising means for replacement of one or more of said plurality of reversing rollers.

* * * * *